US008807678B2

(12) United States Patent
Chung et al.

(10) Patent No.: US 8,807,678 B2
(45) Date of Patent: Aug. 19, 2014

(54) METHODS OF DRIVING AN INKJET PRINTING APPARATUS

(75) Inventors: Jae-woo Chung, Yongin-si (KR); Young-ki Hong, Anyang-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 658 days.

(21) Appl. No.: 12/588,716

(22) Filed: Oct. 26, 2009

(65) Prior Publication Data

US 2010/0265289 A1 Oct. 21, 2010

(30) Foreign Application Priority Data

Apr. 17, 2009 (KR) ..... 10-2009-0033844

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04576* (2013.01); *B41J 2/04593* (2013.01)
USPC ..... 347/10; 347/55

(58) Field of Classification Search
None
See application file for complete search history.

(56) References Cited

U.S. PATENT DOCUMENTS

| | | | | |
|---|---|---|---|---|
| 5,387,834 | A * | 2/1995 | Suzuki | 310/317 |
| 5,477,249 | A * | 12/1995 | Hotomi | 347/48 |
| 5,831,650 | A * | 11/1998 | Reinten | 347/68 |
| 6,729,552 | B1 * | 5/2004 | McEwen et al. | 239/49 |
| 7,314,185 | B2 | 1/2008 | Nishi et al. | |
| 7,695,110 | B2 * | 4/2010 | Ueno et al. | 347/55 |
| 7,938,510 | B2 * | 5/2011 | Kubo et al. | 347/55 |
| 2006/0170753 | A1 * | 8/2006 | Higuchi et al. | 347/112 |
| 2006/0194699 | A1 * | 8/2006 | Moucharafieh et al. | 504/206 |
| 2008/0074476 | A1 * | 3/2008 | Yoo et al. | 347/71 |
| 2008/0122887 | A1 * | 5/2008 | Ueno et al. | 347/10 |

FOREIGN PATENT DOCUMENTS

| | | | | |
|---|---|---|---|---|
| JP | 10166592 | A * | 6/1998 | B41J 2/06 |
| JP | 2004-114370 | | 4/2004 | |
| JP | 2006-192614 | | 7/2006 | |
| JP | 2006-212816 | | 8/2006 | |
| JP | 2006-315232 | | 11/2006 | |
| JP | 2007-106026 | | 4/2007 | |
| JP | 2008-080807 | | 4/2008 | |
| WO | WO 2007099773 | A1 * | 9/2007 | |

* cited by examiner

*Primary Examiner* — Mark Robinson
*Assistant Examiner* — Andrew Jordan
(74) *Attorney, Agent, or Firm* — Harness, Dickey & Pierce, P.L.C.

(57) ABSTRACT

A method of driving a hybrid type inkjet printing apparatus according to example embodiments may use both a piezoelectric method and an electrostatic method. The method of driving may include a plurality of driving modes that are determined by adjusting the order, amplitude, and duration of a piezoelectric driving voltage to a piezoelectric actuator and an electrostatic driving voltage to an electrostatic force applying unit. As a result, ink droplets may be ejected in various sizes and shapes. In a first driving mode, a dome-shaped ink meniscus may be formed at an end portion of a nozzle and ink droplets having a smaller size than the nozzle may be ejected from a surface of the dome-shaped ink meniscus. In a second driving mode, a cone-shaped ink meniscus may be formed at an end of the nozzle, and ink droplets having a smaller size than those of the first driving mode may be ejected from a sharp end portion of the cone-shaped ink meniscus. In a third driving mode, a syringe/cone-shaped ink meniscus may be formed at an end portion of the nozzle and ink in the form of an ink stream may be ejected from a sharp end portion of the syringe/cone-shaped ink meniscus.

10 Claims, 9 Drawing Sheets

METHODS OF DRIVING AN INKJET PRINTING APPARATUS

CROSS-REFERENCE TO RELATED APPLICATION

This application claims priority under 35 U.S.C. §119 to Korean Patent Application No. 10-2009-0033844, filed on Apr. 17, 2009 with the Korean Intellectual Property Office, the entire disclosure of which is incorporated herein by reference.

BACKGROUND

1. Field

Example embodiments relate to methods of driving a hybrid type inkjet printing apparatus using both a piezoelectric force and an electrostatic force.

2. Description of the Related Art

An inkjet printing apparatus may eject droplets of printing ink onto a desired position on a printing medium (e.g., printing paper) using an inkjet head, thereby printing an image of a particular color on the printing paper. The inkjet printing apparatus has been increasingly used in connection with flat display devices (e.g., liquid crystal displays (LCD), organic light emitting devices (OLED)), flexible display devices (e.g., electronic paper (E-paper)), printed electronics (e.g., metal wiring), and organic thin film transistors (OTFT). When the inkjet printing apparatus is used in relation to the above-described display devices or printed electronics, properties like resolution and precision printing are some of the significant technical issues facing manufacturing processes using the inkjet printing apparatus.

Inkjet printing apparatuses may use various ink ejection methods, e.g., piezoelectric ink ejection, electrostatic ink ejection. In a piezoelectric ink ejection method, ink is ejected by deforming a piezoelectric body, while in an electrostatic ink ejection method, ink is ejected by electrostatic force. The electrostatic ink ejection method may be classified as an electrostatic induction ejection method that uses electrostatic induction to eject ink and also as a method in which ink droplets are ejected after accumulating charged pigments by electrostatic force.

An inkjet printing apparatus using a piezoelectric method ejects ink using a drop on demand (DOD) method. Such an inkjet printing apparatus may provide relatively easy control of a printing operation and be driven in a relatively simple manner. Also, because such an inkjet printing apparatus generates ejection energy by mechanical deformation of a piezoelectric body, there is no particular limitation as to the type of ink used. However, it is relatively difficult to eject fine droplets having a size of several picoliters or smaller using a piezoelectric inkjet printing apparatus. Also, the linearity of the ejected ink droplets may be decreased.

An inkjet printing apparatus using an electrostatic method may realize fine droplets with relative ease. Such an apparatus may also be driven in a relatively simple manner with satisfactory linearity of the ejected ink droplets. Thus, such an inkjet printing apparatus may be effective for precision printing. However, when using an electrostatic inkjet printing apparatus that uses electrostatic induction, it may be relatively difficult to control each of the nozzles that form the ink droplets. It may also be relatively difficult to eject ink from multiple nozzles using a DOD method. Furthermore, an electrostatic inkjet printing apparatus using charged pigments needs to accumulate pigments of relatively high density, and the ejection speed thereof and the type of ink used therein may also be limited.

SUMMARY

Example embodiments include methods of driving a hybrid type inkjet printing apparatus using both a piezoelectric force and an electrostatic force, wherein ink droplets of various sizes and shapes may be ejected. A method of driving an inkjet printing apparatus according to example embodiments may include applying a piezoelectric driving voltage to a piezoelectric actuator and an electrostatic driving voltage to an electrostatic force applying unit, wherein the piezoelectric actuator is configured to exert a first driving force and the electrostatic force applying unit is configured to exert a second driving force. The order, amplitude, and duration of the piezoelectric driving voltage and the electrostatic driving voltage may be manipulated such that a combined effect of the first and second driving forces results in a plurality of modes for ejecting ink droplets in various sizes and shapes from a nozzle.

The plurality of modes may include a first driving mode, a second driving mode, and a third driving mode. In the first driving mode, a dome-shaped ink meniscus may be formed at an end portion of the nozzle, and ink droplets having a smaller size than the nozzle may be ejected from a surface of the ink meniscus. In the second driving mode, a cone-shaped ink meniscus may be formed at an end of the nozzle, and ink droplets having a smaller size than the first driving mode may be ejected from a relatively sharp end portion of the ink meniscus. In the third driving mode, a syringe/cone-shaped ink meniscus may be formed at an end portion of the nozzle and ink in the form of an ink stream may be ejected from a relatively sharp end portion of the ink meniscus.

In the first driving mode, the electrostatic driving voltage may be applied before the piezoelectric driving voltage is applied and is removed after the piezoelectric driving voltage is removed, to maintain a longer duration time of the electrostatic driving voltage than a duration time of the piezoelectric driving voltage. In the second driving mode, the piezoelectric driving voltage may be applied and may be removed before the electrostatic driving voltage is applied and is removed, respectively, to maintain a longer duration time of the electrostatic driving voltage than a duration time of the piezoelectric driving voltage. In the third driving mode, the electrostatic driving voltage may be applied and removed before the piezoelectric driving voltage is applied and is removed, respectively, to maintain a longer duration time of the electrostatic driving voltage than a duration time of the piezoelectric driving voltage.

The piezoelectric driving voltage in the first driving mode may be higher than that of the second and third driving modes, while the piezoelectric driving voltage in the third driving mode may be lower than that of the first and second driving modes. The electrostatic driving voltage in the third driving mode may be higher than the electrostatic driving voltage in the first or second driving mode.

In the first and second driving modes, a printing pattern formed of a plurality of relatively fine ink droplets may be formed on a printing medium. In the third driving mode, the ink stream may be extended to a printing medium to form a printing pattern formed of a plurality of solid lines on the printing medium. Furthermore, in the third driving mode, an end portion of the ink stream may be divided into ink droplets, and the divided ink droplets may be distributed toward a printing medium to form a printing pattern that is coated on the printing medium by using a spraying method.

Another method of driving an inkjet printing apparatus may include applying an electrostatic driving voltage to an electrostatic force applying unit so as to exert an electrostatic force to ink in a nozzle of the inkjet printing apparatus; applying a piezoelectric driving voltage to a piezoelectric actuator after the application of the electrostatic driving voltage so as to exert pressure on the ink, thereby forming a dome-shaped ink meniscus at an outlet opening of the nozzle and ejecting ink droplets having a smaller size than the nozzle opening from a surface of the dome-shaped ink meniscus; and removing the piezoelectric driving voltage and the electrostatic driving voltage.

The electrostatic driving voltage may be removed after removing the piezoelectric driving voltage, and a duration time of the electrostatic driving voltage may be maintained longer than a duration time of the piezoelectric driving voltage. Also, a printing pattern formed of a plurality of fine ink dots may be formed on a printing medium.

Another method of driving an inkjet printing apparatus may include applying a piezoelectric driving voltage to a piezoelectric actuator so as to exert pressure on ink in a nozzle of the inkjet printing apparatus; applying an electrostatic driving voltage to an electrostatic force applying unit after the application of the piezoelectric driving voltage so as to exert an electrostatic force on the ink, thereby forming a cone-shaped ink meniscus at an outlet opening of the nozzle and ejecting ink droplets having a smaller size than the nozzle opening from a pointed end portion of the cone-shaped ink meniscus; and removing the piezoelectric driving voltage and the electrostatic driving voltage.

The electrostatic driving voltage may be removed after removing the piezoelectric driving voltage, and a duration time of the electrostatic driving voltage may be maintained longer than a duration time of the piezoelectric driving voltage. Also, a plurality of fine ink dots may be formed on a printing medium.

Another method of driving an inkjet printing apparatus may include applying an electrostatic driving voltage to an electrostatic force applying unit so as to exert an electrostatic force on ink in a nozzle of the inkjet printing apparatus; applying a piezoelectric driving voltage to a piezoelectric actuator after the application of the electrostatic driving voltage so as to exert pressure on the ink, thereby forming a syringe/cone-shaped ink meniscus at an outlet opening of the nozzle and ejecting ink in the form of an ink stream from a pointed end portion of the syringe/cone-shaped ink meniscus; and removing the piezoelectric driving voltage and the electrostatic driving voltage.

The piezoelectric driving voltage may be removed after removing the electrostatic driving voltage, and a duration time of the electrostatic driving voltage may be maintained longer than a duration time of the piezoelectric driving voltage.

The ink stream may be extended to a printing medium so as to create a printing pattern formed of a plurality of solid lines on the printing medium. Furthermore, an end portion of the ink stream may be divided into ink droplets, and the divided ink droplets may be distributed toward a printing medium and form a printing pattern that is coated on the printing medium by using a spraying method.

BRIEF DESCRIPTION OF THE DRAWINGS

The above and/or other aspects of example embodiments may become more apparent and readily appreciated when the following description is taken in conjunction with the accompanying drawings of which.

DETAILED DESCRIPTION

Figure 1A:
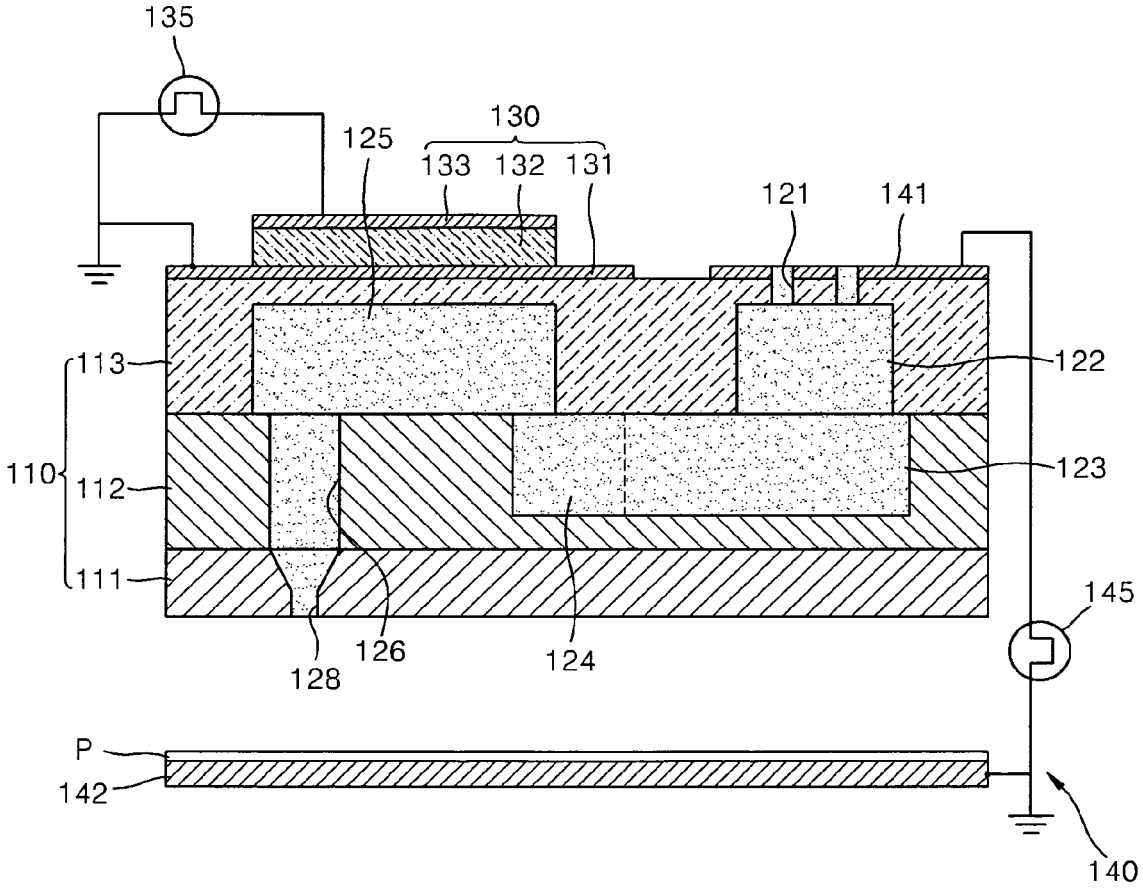
FIGS. 1A and 1B are cross-sectional views illustrating hybrid type inkjet printing apparatuses that use both a piezoelectric method and an electrostatic method according to example embodiments.

It will be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, e.g., "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 1B:
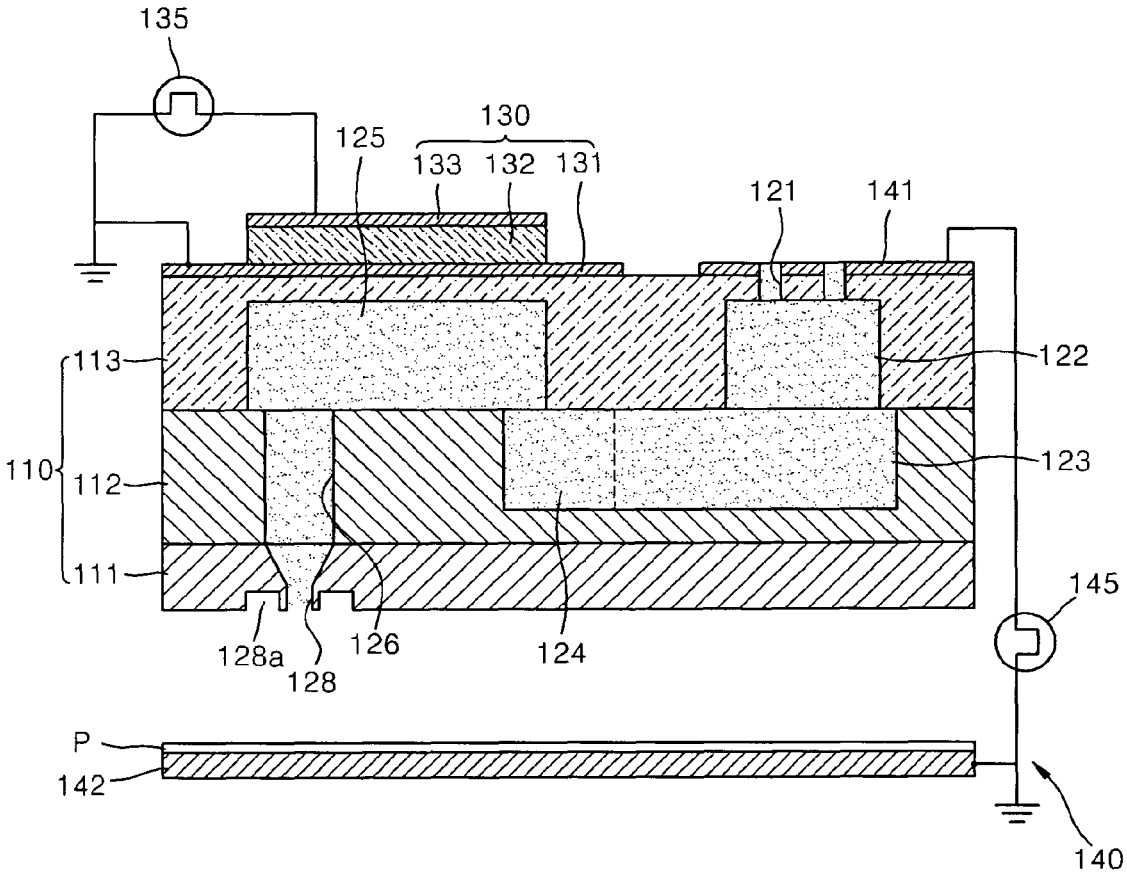

FIGS. 1A and 1B are cross-sectional views illustrating hybrid type inkjet printing apparatuses that use both a piezoelectric method and an electrostatic method according to example embodiments. Referring to FIG. 1A, the inkjet printing apparatus may include a passage plate 110 in which an ink passage is formed, a piezoelectric actuator 130, and an electrostatic force applying unit 140 that provide driving forces for ejecting ink.

The passage plate 110 includes an ink passage, wherein the ink passage may include an ink inlet 121 through which ink flows, a plurality of pressure chambers 125, and a plurality of nozzles 128 for ejecting ink droplets. The ink inlet 121 may be formed on an upper surface of the passage plate 110 and is connected to an ink tank (not shown). Ink supplied from the ink tank flows into the passage plate 110 through the ink inlet 121. The plurality of pressure chambers 125 are formed in the passage plate 110, and the ink supplied through the ink inlet 121 is stored in the pressure chambers 125. Also, manifolds 122 and 123 and a restrictor 124 that connect the ink inlet 121 to the plurality of pressure chambers 125 may be formed in the passage plate 110. The plurality of nozzles 128 may be used to eject the ink stored in the plurality of pressure chambers 125, as droplets, and may be respectively connected to the plurality of pressure chambers 125. The plurality of nozzles 128 may be formed on a lower surface of the passage plate 110 and may be arranged in one or two rows. Also, a plurality of dampers 126 respectively connecting the plurality of pressure chambers 125 and the plurality of nozzles 128 may be formed in the passage plate 110.

The passage plate 110 may be a substrate formed of a material having sufficient microscopic machinability, e.g., a silicon substrate. The passage plate 110 may be formed of three sequentially stacked substrates, e.g., a first substrate 111, a second substrate 112, and a third substrate 113, which are bonded by a silicon direct bonding (SDB) method. In this case, the ink inlet 121 may be formed to vertically pass through the uppermost substrate, e.g., the third substrate 113, and the plurality of pressure chambers 125 may be formed to a depth in the third substrate 113 from a lower surface of the third substrate 113. The plurality of nozzles 128 may be formed to vertically pass through the lowermost substrate, e.g., the first substrate 111. The manifolds 122 and 123 may be respectively formed in the third substrate 113 and the second substrate 112 in the middle, and the plurality of dampers 126 may be formed to vertically pass through the second substrate 112.

Although the passage plate 110 is shown as having three substrates, example embodiments are not limited thereto. For instance, the passage plate 110 may include two substrates or four or more substrates. Furthermore, an ink passage formed therein may also be arranged in a number of different ways.

Referring to FIG. 1B, a trench 128*a* may be formed around the nozzles 128 in the first substrate 111. Because of the trench 128*a*, the nozzle 128 may have the appearance of protruding forward from the first substrate 111.

The piezoelectric actuator 130 may provide a first driving force for ejecting ink, e.g., pressure variations, to the plurality of pressure chambers 125, and may be disposed on the passage plate 110 in a position corresponding to the plurality of pressure chambers 125. The piezoelectric actuator 130 may be formed of a lower electrode 131, a piezoelectric layer 132, and an upper electrode 133 that are sequentially stacked on an upper surface of the passage plate 110. The lower electrode 131 functions as a common electrode, and the upper electrode 133 functions as a driving electrode applying a voltage to the piezoelectric layer 132. To this end, a first power source 135 is connected to the lower electrode 131 and the upper electrode 133. The piezoelectric layer 132 is deformed as a voltage is applied from the first power source 135, thereby deforming the third substrate 113, part of which is an upper wall of the pressure chamber 125. The piezoelectric layer 132 may be formed of a piezoelectric material, e.g., lead zirconate titanate (PZT) ceramic.

The electrostatic force applying unit 140 may apply a second driving force for ejecting ink, e.g., an electrostatic force, to the ink inside the nozzle 128. The electrostatic force applying unit 140 includes a first electrostatic electrode 141 and a second electrostatic electrode 142 that are disposed to face each other and a second power source 145 that applies a voltage between the first and second electrostatic electrodes 141 and 145.

The first electrostatic electrode 141 may be formed on the passage plate 110. In detail, the first electrostatic electrode 141 may be formed on the upper surface of the passage plate 110, e.g., on an upper surface of the third substrate 113. In this case, the first electrostatic electrode 141 may be formed in an area in which the ink inlet 121 is formed, such that the first electrostatic electrode 141 is separated from the lower electrode 131 of the piezoelectric actuator 130. The second electrostatic electrode 142 may be separated a distance from a lower surface of the passage plate 110, and a printing medium P on which the ink droplets ejected from the nozzles 128 of the passage plate 110 are printed is disposed on the second electrostatic electrode 142.

The inkjet printing apparatus having the above-described structure uses both piezoelectric and electrostatic ink ejection methods, and thus has the advantages of both methods. Stated more clearly, the above inkjet printing apparatus may eject ink in a drop on demand (DOD) method, and thus printing operations thereof may be controlled with relative ease. Also, fine droplets may be formed with relative ease using the inkjet printing apparatus with satisfactory linearity of the ejected ink droplets. Thus, with the inkjet printing apparatus according to example embodiments, the technical weak points of printing apparatuses of the related art may be overcome.

A method of driving the inkjet printing apparatus according to example embodiments may include a plurality of driving modes in which ink droplets are ejected in different sizes and shapes. The plurality of driving modes may be determined by adjusting the order of applying a piezoelectric driving voltage to the piezoelectric actuator 130 and an electrostatic driving voltage to the electrostatic force applying unit 140, and adjusting amplitude of the voltages, and duration times for applying the voltages. In detail, the plurality of driving modes may include a first driving mode in which relatively fine droplets having a smaller size than a size of the nozzles 128 are ejected, a second driving mode in which relatively fine droplets that are smaller than those of the first driving mode are ejected, and a third driving mode in which ink droplets are ejected as jet streams. Hereinafter, each of the driving modes of the method of driving the inkjet printing apparatus will be described in further detail. The first driving mode will be referred to as a micro-dripping mode, the second driving mode will be referred to as a cone-jet mode, and the third driving mode will be referred to as a cone-jet stream mode.

Figure 2:
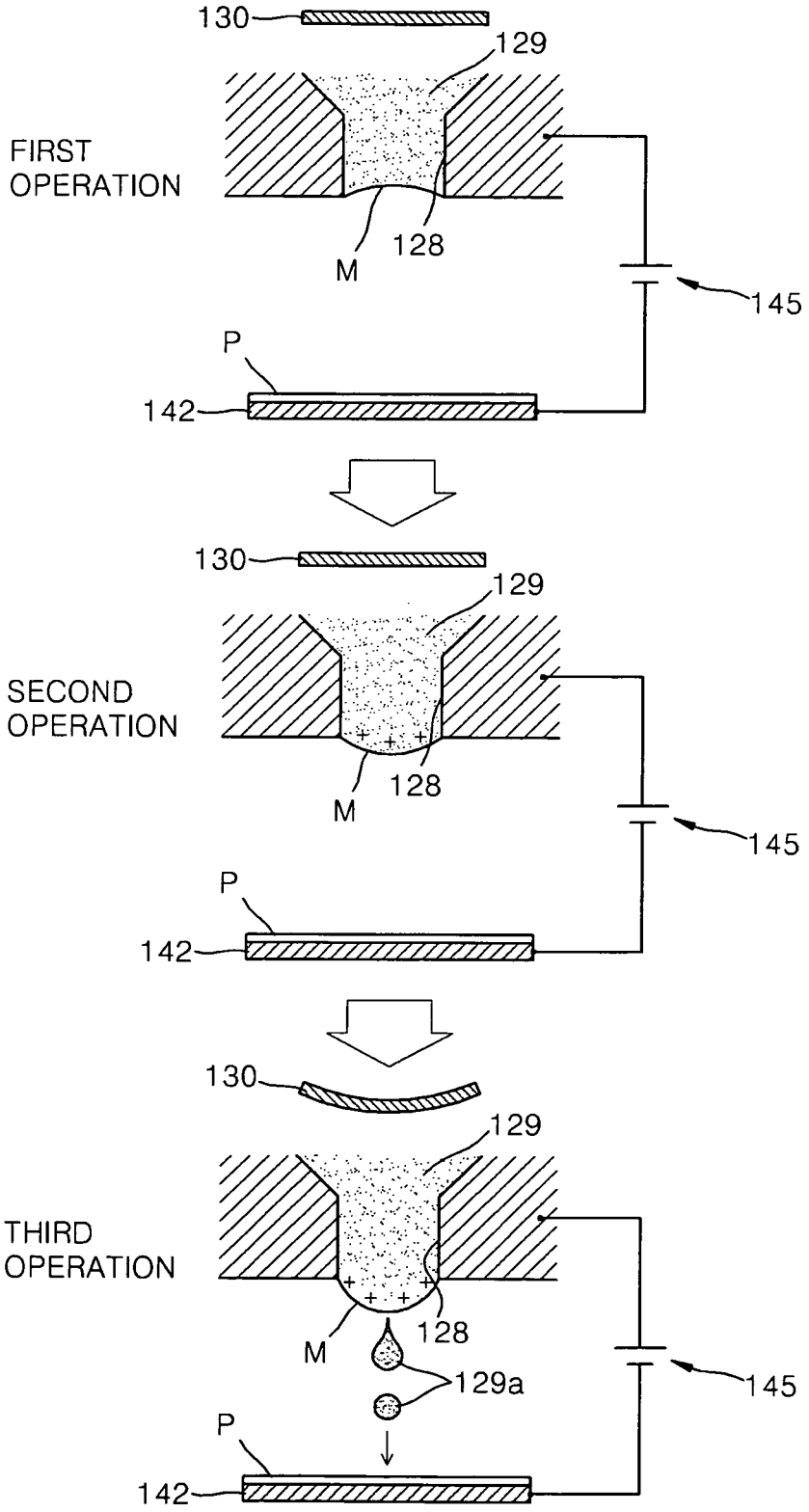
FIG. 2 is a schematic view illustrating a method of driving an inkjet printing apparatus according to example embodiments.
Figure 3:
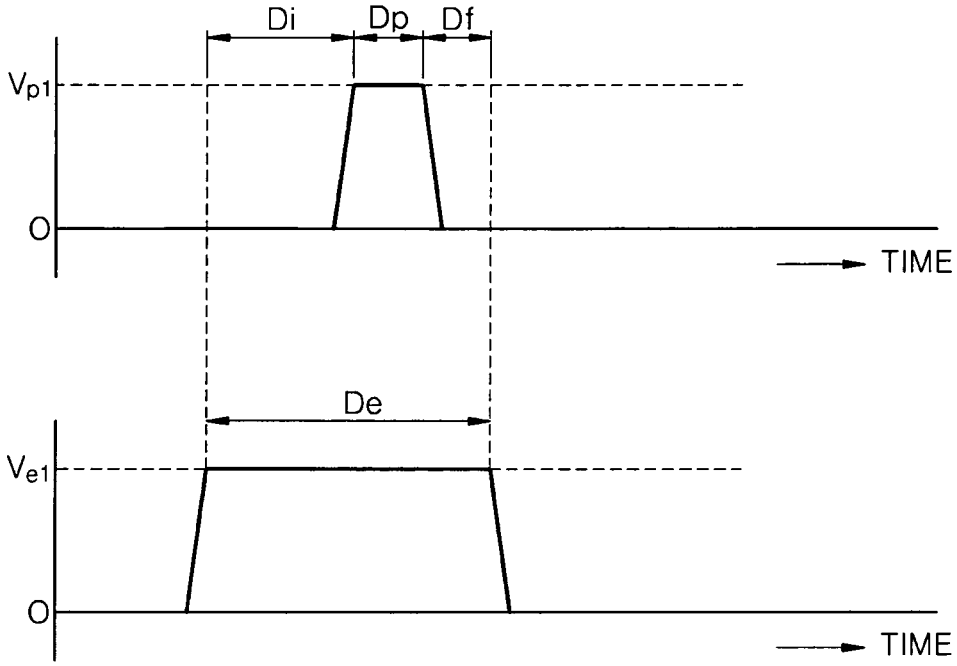
FIG. 3 illustrates a driving waveform for the method of FIG. 2.

FIG. 2 is a schematic view illustrating a method of driving an inkjet printing apparatus according to example embodiments (e.g., micro-dripping mode). FIG. 3 illustrates a driving waveform for the method of FIG. 2. Referring to FIGS. 2 and 3, a first operation denotes an initial state where no voltage is applied to the piezoelectric actuator 130 and the electrostatic force applying unit 140. The ink 129 in the nozzle 128 has a meniscus M which is flat or slightly concave due to surface tension.

In a second operation, a first electrostatic driving voltage $V_{e1}$ is applied between the first electrostatic electrode 141 and the second electrostatic electrode 142 from the second power source 145. The first electrostatic driving voltage $V_{e1}$ may be about 3 KV to about 5 KV. Accordingly, as an electrostatic force is applied to the ink 129 in the nozzle 128, the meniscus M of the ink 129 is deformed to be slightly convex. When the convex meniscus M is formed in the ink 129, an electrical field is focused in the convex meniscus M. Thus, positive charges in the ink 129 move toward the second electrostatic electrode 142 and are gathered in an end portion of the nozzle 128.

In a third operation, after applying the first electrostatic driving voltage $V_{e1}$, a first piezoelectric driving voltage $V_{p1}$ is applied to the piezoelectric actuator 130 to deform the piezoelectric actuator 130 so as to reduce a volume of the pressure chamber 125. The applied first piezoelectric driving voltage $V_{p1}$ may be about 50 V to about 90 V, which is higher than a piezoelectric driving voltage in the cone-jet mode or in the cone-jet stream mode, which will be described below. An initial delay time $D_i$ from a peak value of the first electrostatic driving voltage $V_{e1}$ to a peak value of the first piezoelectric driving voltage $V_{p1}$ may be about 30 μs.

As described above, when the first piezoelectric driving voltage $V_{p1}$ is applied after the first electrostatic driving voltage $V_{e1}$ has been applied, the volume of the pressure chamber 125 is reduced and thus a pressure therein is increased, and the meniscus M of the ink 129 formed in the nozzle 128 becomes more convex and finally has a dome shape. Accordingly, a curvature radius of the meniscus M of the ink 129 is reduced, and more positive charges are gathered at a convex tip of the meniscus M.

Generally, an electrostatic force $F_E$ is in proportion to a charge amount (q) and the intensity of an electrical field E, as shown in Expression 1 below. Also, as represented by Expression 2, the charge amount (q) is also in proportion to the intensity of an electrical field E. Consequently, the electrostatic force $F_E$ is in proportion to the square of the intensity of an electrical field E. Also, as represented by Expression 4, the intensity of the electrical field E is in proportion to an applied electrostatic voltage $V_E$, but is in inverse proportion to a curvature radius $r_m$ of a meniscus M. Accordingly, as represented by Expression 5, the electrostatic force $F_E$ applied to the ink 129 that protrudes sharply at an end of the nozzle 128 is in inverse proportion to the square of the curvature radius $r_m$ of the meniscus M at the end of the nozzle 128.

$$F_E \propto qE \quad \text{[Expression 1]}$$

$$q \propto E \quad \text{[Expression 2]}$$

$$F_E \propto E^2 \quad \text{[Expression 3]}$$

$$E \propto \frac{V_E}{r_m} \quad \text{[Expression 4]}$$

$$F_E \propto \left(\frac{V_E}{r_m}\right)^2 \quad \text{[Expression 5]}$$

As described above, the electrostatic force $F_E$ applied to the convex portion of the ink 129 is increased, and accordingly, the curvature radius of the meniscus M in a center portion of the nozzle 128 is further reduced, and this further increases the electrostatic force $F_E$. In the end, the convex portion of the ink 129 falls off from a surface of the meniscus M as a droplet **129*a*. Accordingly, the ink droplet 129*a* having a much smaller size than the size of the nozzle 128 may be ejected. The ink droplet 129*a*, which is separated as described above, is moved toward the second electrostatic electrode 142** due to the electrostatic force $F_E$ and is printed on a printing medium P. Here, a printing pattern formed of a plurality of fine dots may be formed on the printing medium P.

Next, the first piezoelectric driving voltage $V_{p1}$ applied to the piezoelectric actuator 130 is removed, and then, the first electrostatic driving voltage $V_{e1}$ applied between the first and second electrostatic electrodes 141 and 142 is removed after a period of time. Then the piezoelectric actuator 130 returns to its original state, and the pressure in the pressure chamber 125 also returns to its original state. Accordingly, the convex meniscus M also regains its original form, as in the first operation.

At least part of a piezoelectric pulse and at least part of an electrostatic pulse may overlap. A final delay time $D_f$ from the removal of the first piezoelectric driving voltage $V_{p1}$ to the removal of the first electrostatic driving voltage $V_{e1}$ may be about 20 μs. Thus, as described above, in the first driving mode, e.g., the micro-dripping mode, the first electrostatic driving voltage $V_{e1}$ is applied before the first piezoelectric driving voltage $V_{p1}$ and removed after the first piezoelectric driving voltage $V_{p1}$ is removed, and thus a duration time De of the first electrostatic driving voltage $V_{e1}$ is longer than a duration time $D_p$ of the first piezoelectric driving voltage $V_{p1}$. The duration time $D_p$ of the first piezoelectric driving voltage $V_{p1}$ may be about 5 μs.

According to the first driving mode, e.g., the micro-dripping mode, relatively fine ink droplets, which are smaller than the size of a nozzle, may be ejected. For example, relatively fine ink droplets having a volume of several picoliters or smaller may be ejected through a nozzle having a diameter of several μm to several tens of μm. Also, a nozzle having a relatively large diameter may be used while ejecting fine droplets, and thus clogging of the nozzle is less likely to occur.

Figure 4:
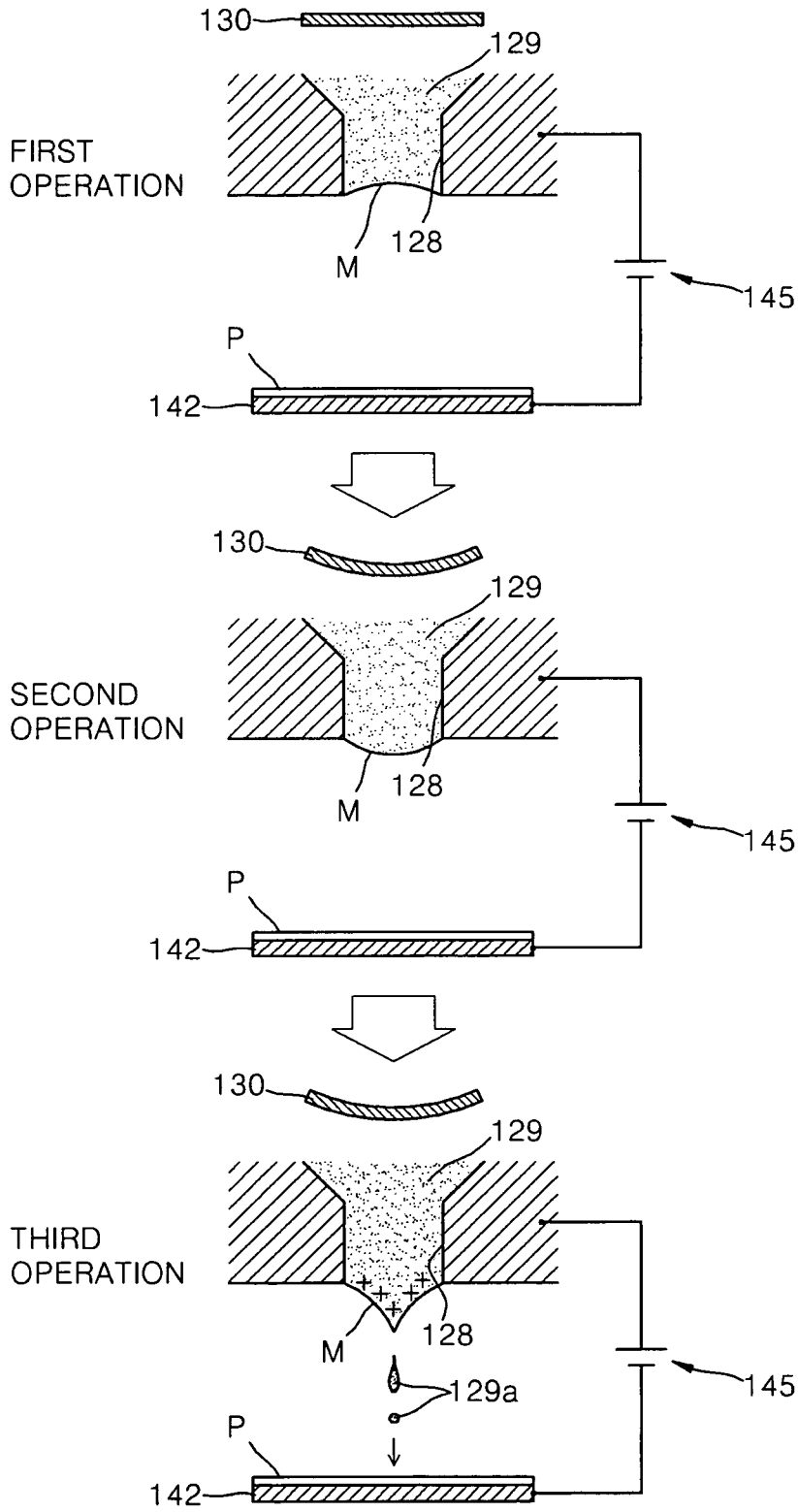
FIG. 4 is a schematic view illustrating another method of driving an inkjet printing apparatus according to example embodiments.
Figure 5:
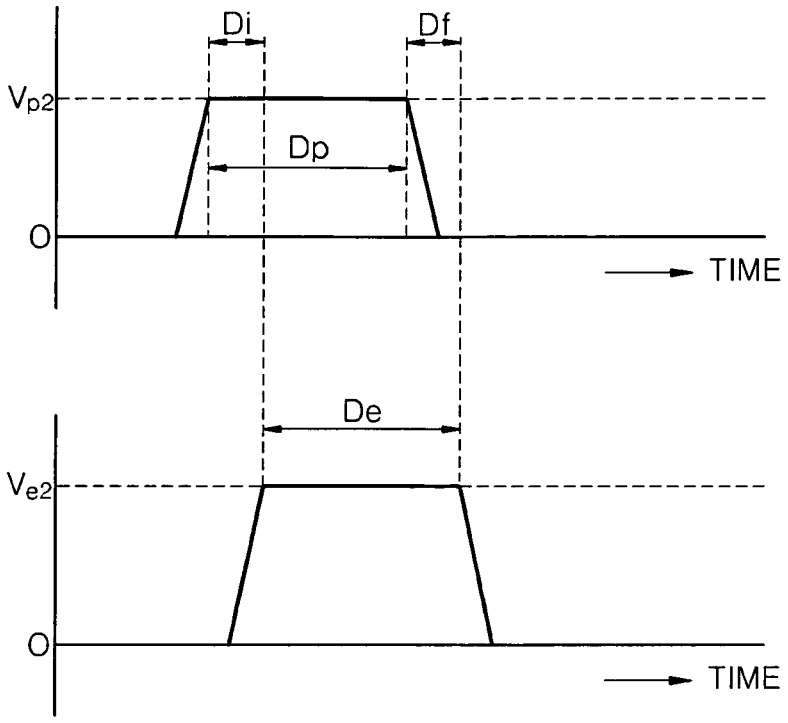
FIG. 5 illustrates a driving waveform for the method of FIG. 4.

FIG. 4 is a schematic view illustrating another method of driving an inkjet printing apparatus according to example embodiments (e.g., cone-jet mode). FIG. 5 illustrates a driving waveform for the method of FIG. 4. Referring to FIGS. 4 and 5, a first operation denotes an initial state in which no voltage is applied to the piezoelectric actuator 130 and the electrostatic force applying unit 140. The ink 129 in the nozzle 128 has a meniscus M that is flat or slightly concave due to surface tension.

In a second operation, a second piezoelectric driving voltage $V_{p2}$ is applied to deform the piezoelectric actuator 130 so as to reduce a volume of the pressure chamber 125. The second piezoelectric driving voltage $V_{p2}$ may be about 25 V to about 40 V, which is lower than the first piezoelectric driving voltage $V_{p1}$ of the above-described micro-dripping mode and greater than a piezoelectric driving voltage in the cone-jet stream mode which will be described later. Accordingly, as a volume of the pressure chamber 125 is reduced and the pressure is increased, the meniscus M of the ink 129 in the nozzle 128 is deformed to be convex.

In a third operation, after applying the second piezoelectric driving voltage $V_{p2}$, a second electrostatic driving voltage $V_{e2}$ is applied between the first electrostatic electrode 141 and the second electrostatic electrode 142 from a second power source 145. The second electrostatic driving voltage $V_{e2}$ may be about 3 KV to about 5 KV. An initial delay time $D_i$ from a peak value of the second piezoelectric driving voltage $V_{p2}$ to a peak value of the second electrostatic driving voltage $V_{e2}$ may be about 9 μs.

When the second electrostatic driving voltage $V_{e2}$ is applied as described above, an electrical field is focused in a convex portion of the ink 129, and positive charges in the ink 129 move toward the second electrostatic electrode 142 and are gathered at an end portion of the nozzle 128, and thus an electrostatic force $F_E$ applied to the convex portion of the ink 129 is increased. When the electrical conductivity of the ink 129 is relatively low and the viscosity thereof is relatively high, the meniscus M of the ink 129 may be formed to have a Taylor cone shape.

The Taylor cone-shaped portion of the ink 129 may be separated as a droplet 129*a* from the ink 129 in the nozzle 128. The ink droplet 129*a* may be separated from a relatively sharp tip of the Taylor cone-shaped meniscus M. Thus, the size of the ink droplet 129*a* may be smaller than the size of an ink droplet in the above-described micro-dripping mode. The ink droplet 129*a*, which is separated in this manner, moves toward the second electrostatic electrode 142 due to the electrostatic force $F_E$ and is printed on a printing medium P. Here, a printing pattern formed of a plurality of finer dots may be formed on the printing medium P.

The second piezoelectric driving voltage $V_{p2}$ applied to the piezoelectric actuator 130 is removed, and then, the second electrostatic driving voltage Ve2 applied between the first and second electrostatic electrodes 141 and 142 is removed after a period of time. Then the piezoelectric actuator 130 returns to its original state, and the pressure in the pressure chamber 125 also returns to its original state. Thus the Taylor cone-shaped meniscus M also regains its original form, as in the first operation.

At least part of a piezoelectric pulse and at least part of an electrostatic pulse may overlap. A final delay time $D_f$ from the removal of the second piezoelectric driving voltage $V_{p2}$ to the removal of the second electrostatic driving voltage $V_{e2}$ may be about 20 μs. Thus, as described above, in the cone-jet mode, the second piezoelectric driving voltage $V_{p2}$ is applied before the second electrostatic driving voltage $V_{e2}$ and removed before the second electrostatic driving voltage $V_{e2}$ is removed, and a duration time De of the second electrostatic driving voltage $V_{e2}$ is longer than a duration time $D_p$ of the second piezoelectric driving voltage $V_{p2}$. The duration time $D_p$ of the second piezoelectric driving voltage $V_{p2}$ may be about 22 μs, which is longer than the duration time of the first piezoelectric driving voltage $V_{p1}$ in the above-described micro-dripping method. According to the cone-jet mode, finer ink droplets may be ejected compared to the micro-dripping mode.

The micro-dripping mode and the cone-jet mode are influenced by the electrical conductivity and the viscosity of the ink. For example, when ink having relatively high electrical conductivity and relatively low viscosity is used, a charging speed of charges toward a surface of the ink is increased, and thus ink droplets may be separated with relative ease from a dome-shaped meniscus before a Taylor cone-shaped meniscus is formed. Thus, ink droplets may be ejected with relative ease by the micro-dripping mode. On the other hand, when ink having lower electrical conductivity and higher viscosity is used, a charging speed of charges that move toward a surface of the ink is decreased and thus a Taylor cone-shaped meniscus M may be formed with relative ease. Thus, finer ink droplets may be ejected using the cone-jet mode. In addition, in the cone-jet mode, a relatively low piezoelectric driving voltage may be maintained so that an electrostatic force that pushes the ink 129 to the outside of the nozzle 128 is greater than a pressure that pulls the ink 129 to the outside of the nozzle 128 to form a Taylor cone-shaped meniscus M. Accordingly, the above two ejection modes may be used appropriately according to the characteristics of the ink.

Figure 6:
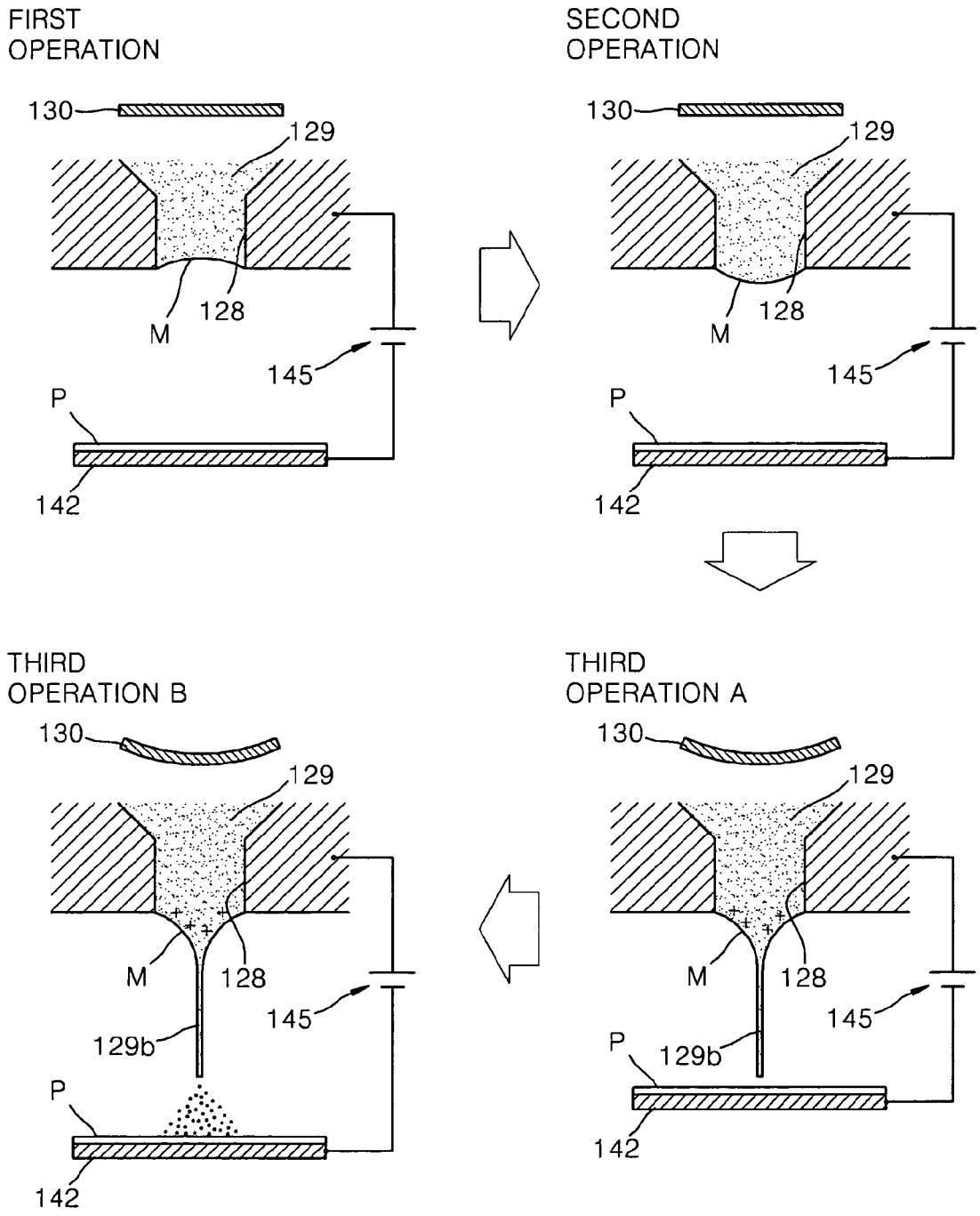
FIG. 6 is a schematic view illustrating another method of driving an inkjet printing apparatus according to example embodiments.
Figure 7:
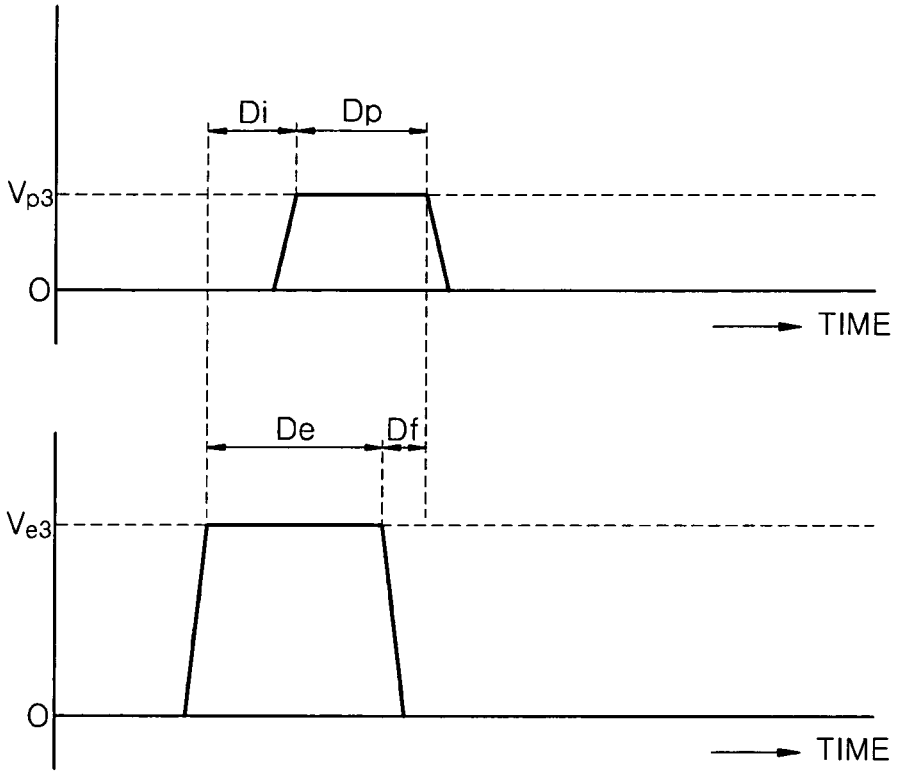
FIG. 7 illustrates a driving waveform for the method of FIG. 6.

FIG. 6 is a schematic view illustrating another method of driving an inkjet printing apparatus according to example embodiments (e.g., cone-jet stream mode). FIG. 7 illustrates a driving waveform for the method of FIG. 6. Referring to FIGS. 6 and 7, a first operation denotes an initial state in which no voltage is applied to the piezoelectric actuator 130 and the electrostatic force applying unit 140. Here, the ink 129 in the nozzle 128 shows a flat or slightly concave meniscus M due to surface tension.

In a second operation, a third electrostatic driving voltage $V_{e3}$ is applied between the first electrostatic electrode 141 and the second electrostatic electrode 142 from a second power source 145. The third electrostatic driving voltage $V_{e3}$ may be about 5 KV to about 7 KV. Accordingly, as an electrostatic force is applied to the ink 129 in the nozzle 128, the meniscus M of the ink 129 is deformed to be slightly convex. Thus, when the convex meniscus M is formed, an electrical field is focused in the convex meniscus M, and positive charges in the ink 129 move toward the second electrostatic electrode 142 and gather at an end portion of the nozzle 128.

In a third operation A, after applying the third electrostatic driving voltage $V_{e3}$, a third piezoelectric driving voltage $V_{p3}$ is applied to the piezoelectric actuator 130 to deform the piezoelectric actuator 130 so as to reduce a volume of the pressure chamber 125. Here, the applied third piezoelectric driving voltage $V_{p3}$ is about 10 V, which is lower than the piezoelectric driving voltage $V_{p1}$ or $V_{p2}$ of the micro-dripping mode or the cone-jet mode, respectively. An initial delay time $D_i$ from a peak value of the third electrostatic driving voltage $V_{e3}$ to a peak value of the third piezoelectric driving voltage $V_{p3}$ may be about 18 μs.

As described above, when the third piezoelectric driving voltage $V_{p3}$ is applied after the third electrostatic driving voltage $V_{e3}$ has been applied, a volume of the pressure chamber 125 is reduced and thus a pressure therein is increased, and thus the ink 129 in the nozzle 128 is pushed to the outside. The third pressure driving voltage $V_{p3}$ is maintained relatively low, and the third electrostatic driving voltage $V_{e3}$ is maintained relatively high, and thus an electrostatic force that pulls the ink 129 to the outside of the nozzle 128 is greater than a pressure that pushes the ink 129 to the outside of the nozzle 128, and thus a Taylor cone-shaped meniscus M may be formed. Furthermore, when the ink 129 has a relative low electrical conductivity and a relatively high viscosity, the Taylor cone-shaped meniscus M may be formed with greater ease. The sharp, Taylor cone-shaped portion of the ink 129 may be extended as an ink stream 129*b* toward the second electrostatic electrode 142 by an electrostatic force $F_E$. When the printing medium P and the nozzle 128 are disposed relatively close to each other, the ink stream 129*b* may extend to the printing medium P. In this case, a printing pattern formed of a plurality of solid lines may be formed on the printing medium P.

On the other hand, referring to a third operation B illustrated in FIG. 6, when the printing medium P and the nozzle 128 are disposed relatively far from each other, the ink stream 129*b* may not extend to the printing medium P, and an end portion of the ink stream 129*b* may be divided into super-fine ink droplets near the printing medium P and be distributed over the printing medium P. In this case, a printing pattern that is at least partially coated by using a spraying method may be formed on the printing medium P.

The third electrostatic driving voltage $V_{e3}$ applied between the first electrostatic electrode 141 and the second electrostatic electrode 142 is removed, and then, after a period of time, the third piezoelectric driving voltage $V_{p3}$ applied to the piezoelectric actuator 130 is removed. Then, the piezoelectric actuator 130 returns to its original state, and the pressure in the pressure chamber 125 also returns to its original state. Thus the Taylor cone-shaped meniscus M also regains its original form, as in the first operation.

At least part of a piezoelectric pulse and at least part of an electrostatic pulse may overlap. A final delay time $D_f$ from the removal of the third electrostatic driving voltage $V_{e3}$ to the removal of the third piezoelectric driving voltage $V_{e3}$ may be about 5 μs. Thus, as described above, in the cone-jet stream mode, the third electrostatic driving voltage $V_{e3}$ is applied before the third piezoelectric driving voltage $V_{p3}$ and is removed before the third piezoelectric driving voltage $V_{p3}$ is removed, and a duration time $D_e$ of the third electrostatic driving voltage $V_{e3}$ is longer than a duration time $D_p$ of the third piezoelectric driving voltage $V_{p3}$. The duration time $D_p$ of the third piezoelectric driving voltage $V_{p3}$ may be about 12 μs, which is longer than that of the first piezoelectric driving voltage $V_{p1}$ of the micro-dripping mode but shorter than that of the second piezoelectric driving voltage $V_{p2}$ of the cone-jet mode.

According to the above-described cone-jet stream mode, ink may be extended as a stream to create a printing pattern formed of a plurality of solid lines on a printing medium P. Alternatively, the ink stream may be distributed to form a printing pattern that is coated using a spraying method on the printing medium P.

Figure 8:
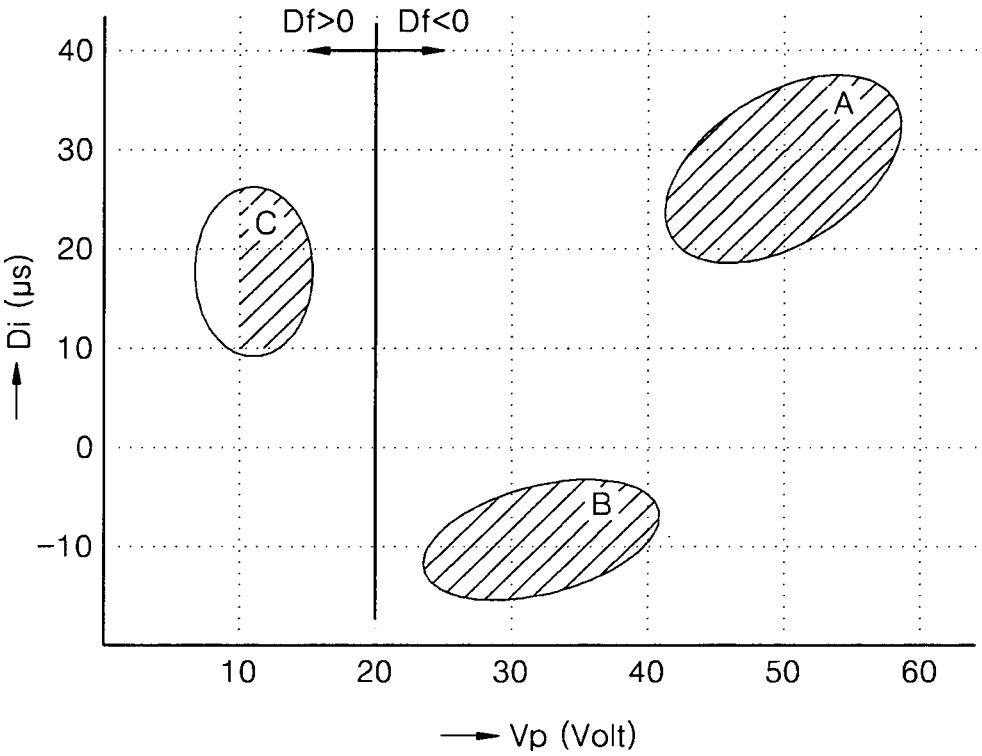
FIG. 8 illustrates the control conditions of three driving modes according to example embodiments.

FIG. 8 illustrates the control conditions of three driving modes according to example embodiments. In FIG. 8, A denotes the micro-dripping mode, B denotes the cone-jet mode, and C denotes the cone-jet stream mode. When the initial delay time $D_i$ is greater than 0, an electrostatic driving voltage is applied before a piezoelectric driving voltage is applied, and when the initial delay time $D_i$ is smaller than 0, an electrostatic driving voltage is applied after a piezoelectric driving voltage is applied. When a final delay time $D_f$ is greater than 0, the electrostatic driving voltage is removed before the piezoelectric driving voltage is removed, and when the final delay time $D_f$ is smaller than 0, the electrostatic driving voltage is removed after the piezoelectric driving voltage is removed.

Referring to FIG. 8, the micro-dripping mode (A), the cone-jet mode (B), or the cone-jet stream mode (C) may be realized by adjusting the initial delay time $D_i$ related to the order of applying a piezoelectric voltage $V_p$ and an electrostatic driving voltage $V_e$, adjusting the duration times $D_p$ and $D_e$ of the piezoelectric voltage $V_p$ and the electrostatic driving voltage $V_e$, and adjusting the amplitude of the piezoelectric driving voltage $V_p$, and relatively fine ink droplets having various sizes and shapes may be ejected according to the driving modes accordingly, thereby printing an image in various patterns.

The inkjet printing apparatus according to example embodiments may be driven using both a piezoelectric ink ejection method and an electrostatic ink ejection method. Thus, ink may be ejected using a DOD method. As a result, a printing operation of the inkjet printing apparatus may be controlled with greater ease, and relatively fine ink droplets having a much smaller size than a nozzle may be ejected.

By adjusting the amplitudes of the piezoelectric driving voltage and the electrostatic driving voltage, and by adjusting the duration times and the application order thereof, relatively fine ink droplets having various sizes and shapes may be realized, and patterns of various shapes may be printed accordingly.

While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

What is claimed is:

1. A method of driving an inkjet printing apparatus, comprising:

applying an electrostatic driving voltage to an electrostatic force applying unit so as to exert an electrostatic force on ink in a nozzle of the inkjet printing apparatus;

applying a piezoelectric driving voltage to a piezoelectric actuator after the application of the electrostatic driving voltage so as to exert pressure on the ink, thereby forming a dome-shaped ink meniscus at an outlet opening of the nozzle and ejecting ink droplets having a smaller size than the nozzle opening from a surface of the dome-shaped ink meniscus; and removing the piezoelectric driving voltage and the electrostatic driving voltage, wherein, at least part of a pulse of the piezoelectric driving voltage overlaps at least part of a pulse of the electrostatic driving voltage, an initial delay time from a peak value of the electrostatic pulse to a peak value of the piezoelectric pulse is greater than a final delay time from a removal of the piezoelectric pulse to a removal of the electrostatic pulse, and the piezoelectric pulse and the electrostatic pulse are associated with a same nozzle.

2. The method of claim 1, wherein a duration of the electrostatic driving voltage is longer than that of the piezoelectric driving voltage.

3. The method of claim 1, wherein the ink droplets are ejected onto a printing medium to form a printing pattern, the printing pattern being a plurality of ink dots.

4. A method of driving an inkjet printing apparatus, comprising:

applying a piezoelectric driving voltage to a piezoelectric actuator so as to exert pressure on ink in a nozzle of the inkjet printing apparatus;

applying an electrostatic driving voltage to an electrostatic force applying unit after the application of the piezoelectric driving voltage so as to exert an electrostatic force on the ink, thereby forming a cone-shaped ink meniscus at an outlet opening of the nozzle and ejecting ink droplets having a smaller size than the nozzle opening from a pointed end portion of the cone-shaped ink meniscus; and removing the piezoelectric driving voltage and the electrostatic driving voltage, wherein, at least part of a pulse of the piezoelectric driving voltage overlaps at least part of a pulse of the electrostatic driving voltage, an initial delay time from a peak value of the piezoelectric pulse to a peak value of the electrostatic pulse is less than a final delay time from a removal of the piezoelectric pulse to a removal of the electrostatic pulse, and the piezoelectric pulse and the electrostatic pulse are associated with a same nozzle.

5. The method of claim 4, wherein a duration of the electrostatic driving voltage is longer than that of the piezoelectric driving voltage.

6. The method of claim 4, wherein the ink droplets are ejected onto a printing medium to form a printing pattern, the printing pattern being a plurality of ink dots.

7. A method of driving an inkjet printing apparatus, comprising:

applying an electrostatic driving voltage to an electrostatic force applying unit so as to exert an electrostatic force on ink in a nozzle of the inkjet printing apparatus;

applying a piezoelectric driving voltage to a piezoelectric actuator after the application of the electrostatic driving voltage so as to exert pressure on the ink, thereby forming a syringe-shaped ink meniscus at an outlet opening of the nozzle and ejecting ink in the form of an ink stream from a pointed end portion of the syringe-shaped ink meniscus; and removing the piezoelectric driving voltage and the electrostatic driving voltage, wherein at least part of a pulse of the piezoelectric driving voltage overlaps at least part of a pulse of the electrostatic driving voltage, an initial delay time from a peak value of the electrostatic pulse to a peak value of the piezoelectric pulse is greater than a final delay time from a removal of the electrostatic pulse to a removal of the piezoelectric pulse, and the piezoelectric pulse and the electrostatic pulse are associated with a same nozzle.

8. The method of claim 7, wherein a duration of the electrostatic driving voltage is longer than that of the piezoelectric driving voltage.

9. The method of claim 7, wherein the ink stream extends to a printing medium and to form a printing pattern, the printing pattern being a plurality of solid lines on the printing medium.

10. The method of claim 7, wherein a terminal portion of the ink stream becomes ink droplets, and the ink droplets are distributed toward a printing medium in a spraying manner to form a printing pattern.

* * * * *